US006846043B1

(12) United States Patent
Leoutsakos

(10) Patent No.: US 6,846,043 B1
(45) Date of Patent: Jan. 25, 2005

(54) ADJUSTABLE SUPPORT

(76) Inventor: Thomas Leoutsakos, P.O. Box 253, Medford, MA (US) 02155

( * ) Notice: Subject to any disclaimer, the term of this patent is extended or adjusted under 35 U.S.C. 154(b) by 0 days.

(21) Appl. No.: 10/764,631

(22) Filed: Jan. 26, 2004

Related U.S. Application Data

(63) Continuation-in-part of application No. 10/228,386, filed on Aug. 27, 2002, now Pat. No. 6,682,147.

(51) Int. Cl.[7] ..... A47C 16/02

(52) U.S. Cl. ..... 297/423.46; 297/423.41; 297/423.45; 297/423.43; 297/423.44; 248/346.06; 248/371; 248/423; 248/448; 108/147.11; 108/147.21; 108/157.1; 108/157.13; 108/157.16; 108/157.17; 108/159

(58) Field of Search ..... 297/423.46, 423.45, 297/423.44, 423, 43, 423.41, 423.39, 344.12, 175, 178; 248/448, 118.3, 346.06, 371, 423; 108/147.11, 147.19, 147.21, 157.1, 157.13, 157.16, 157.17, 159

(56) References Cited

U.S. PATENT DOCUMENTS 3,132,835 A * 5/1964 Drabert ..... 297/423.45 X
3,163,468 A * 12/1964 Koch ..... 297/432.46
3,653,715 A * 4/1972 Drabert et al. ..... 297/423.45
4,873,966 A * 10/1989 Gitter
5,201,568 A * 4/1993 Christensen, Jr. ..... 297/423.46
5,294,180 A * 3/1994 Grimm ..... 297/423.44
5,356,203 A * 10/1994 Levasseur et al. ..... 297/423.45
5,419,618 A * 5/1995 Hatcher ..... 297/423.46
5,577,806 A * 11/1996 Ugalde ..... 297/423.46
5,584,535 A * 12/1996 Jacobson et al. ..... 297/423.46
5,626,393 A * 5/1997 Levasseur et al. ..... 297/423.46
6,454,357 B1 * 9/2002 Foulger ..... 297/423.41
6,682,147 B1 * 1/2004 Leoutsakos ..... 297/423.41

FOREIGN PATENT DOCUMENTS

DE 3728717 A * 3/1989 ..... A47C/16/02
DE 4304531 A1 * 8/1994 ..... A47C/16/02

* cited by examiner

*Primary Examiner*—Rodney B. White
(74) *Attorney, Agent, or Firm*—G. Kersey

(57) ABSTRACT

Method and apparatus providing a rest member having a support surface and a stand for the rest member, with the rest member having a plural multiplicity of apertures therein to permit the adjustment in height thereof with respect to the stand, which can take the form of an expandable member associated with the rest member and being contractable as well as expandable inwardly and outwardly and accompanied by means for inhibiting the separation of the rest member from stand after the rest member has been positioned on the stand.

18 Claims, 4 Drawing Sheets

ADJUSTABLE SUPPORT

This is a Continuation in Part of Ser. No. 10/228,386, filed Aug. 27, 2002, scheduled to issue as U.S. Pat. No. 6,682,147 on Jan. 27, 2004. The invention relates to an adjustable support and, more particularly, to a foot rest support which can be adjusted in both height and width.

BACKGROUND OF THE INVENTION

1. Field of the Invention

2. Description of the Need for the Invention

Many persons, particularly elderly and disabled persons, often desire to have an accessory, such as a foot rest, which can be used in a variety of ways. In one usage, a person might wish to elevate the foot or both feet in order to alleviate a physical condition, such as pain that is occasioned by having the foot occupy a restrained position for a prolonged period of time. In other usages, the foot rest can provide a suitable support when the person is seated or is in a position where such support is desired.

The prior art provides a number of footrest. One type is provided by a frame that is inserted into separated slots of a plate, but this arrangement is not adjustable in height or width.

Other solutions have been proposed which typically are complex and costly.

Accordingly, it is a principal object of the invention to provide a support that is inexpensive and simple to construct and can meet the requirements of persons who wish to adjustably support body appendages such as legs in order to satisfy a physical or exercise requirement.

SUMMARY OF THE INVENTION

In accomplishing the foregoing and related objects, the invention provides a rest member having a support surface; and a stand for the rest member; which has apertures therein to permit the adjustment in height thereof with respect to the stand; and the stand has means thereon for inhibiting any tendency for the stand to become separated from the rest member during usage thereof.

In accordance with one aspect of the invention, the inhibiting means is compressible to permit the stand to be inserted thru the rest member and expandable thereafter to inhibit separation of the rest member from the stand. The inhibiting means can comprise at least one object. Alternatively, the inhibiting means can be a projection from the stand to inhibit separation of the rest member once it is positioned on the stand. The projection can can have the same or a lesser width that portion of the rest member that is inserted on the stand.

Where the stand has a tubular portion the object can be attached to the tubular portion, and the object can projects from the stand, being compressible if the object is wider than the tubular portion and being non-compressible if the object is equal or narrower than the tubular portion, which can have a variety of cross sections and include a rectilinear channel member having an open side. Alternatively, the stand can be a solid member.

In accordance with another aspect of the invention, the inhibiting member is movable inwardly and outwardly, and can comprise an elastomeric object, or a plurality of elastomeric objects, such as a rubber ring.

In accordance with a further aspect of the invention, the stand can have an apex and the inhibiting means can be positioned at the apex.

In a method of the invention for supporting an object, the steps can include (a) providing a rest member having a support surface; (b) forming a plurality of differently dimensioned constructs in the support surface; and (c) positioning the rest member on a stand therefor to permit the adjustment in height of the rest member with respect to the constructs The method can include the step of positioning means for inhibiting the accidental separation of the stand from said rest member after the stand has engaged the constructs, which can be apertures.

The stand can have at least one apex and further include the step of positioning inhibiting means at the apex, with the inhibiting means comprising an elastomeric object and further include the step of engaging at least one of the constructs by the elastomeric object, which can take the form of a rubber ring and further include the step of engaging at least one construct by the rubber ring.

At least one of the constructs can be an aperture smaller than the maximum dimension of the rubber ring when positioned on the stand and further include compressing the rubber ring to allow insertion into the aperture, followed by the step of pushing the rubber ring thru the aperture.

The rubber ring can be variably positioned on the stand.

The method can further include the step of providing the rest member with a plurality of elongated apertures of different lengths, with the stand inserted into two of the apertures and inhibited from separation therefrom by the inhibiting means.

DESCRIPTION OF THE DRAWINGS

Other aspects of the invention will become apparent after considering several illustrative embodiments taken in conjunction with the drawings in which.

DETAILED DESCRIPTION

Figure 1:
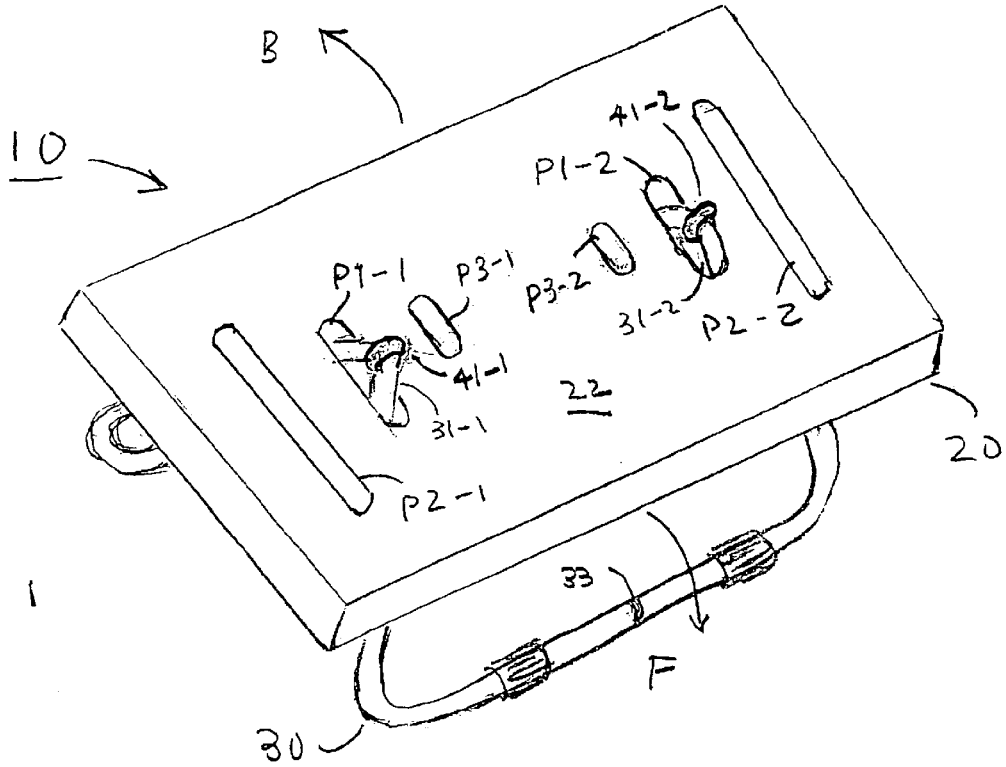
FIG. 1 is a perspective view of an adjustable support in accordance with the invention that permits forward and backward movement of its support surface and inhibits separation of the support surface from its stand.

As shown in the perspective view of FIG. 1, an adjustable support 10 in accordance with the invention is formed by a support member 20 having a support surface 22 and a plurality of pairs P1 thru P3 of elongated apertures in the support surface 22. In the embodiment of FIG. 1 there are three pairs of apertures P1, P2 and P3, with the first pair P1 formed by elongated apertures P1-1 and P1-2, the second, shorter pair P2 formed by elongated apertures P2-1 and P2-2, and the third pair P3-1 and P3-2 formed by a still shorter pair P3. The longer pair P2 accompanies the shorter pairs P1 and P3 in order to permit adjustment in height of the support surface 22 with respect to a stand 30. The support member 20 is positioned at its aperture positions over apex portions 31-1 and 31-2 of the stand 30, which includes apex inhibiting grommets 41-1 and 41-2.

As illustrated in FIG. 1, the support member 20 has its apertures P1-1 and P1-2 on the apex members 31-1 and 31-2 so that the support surface is in its intermediate lower position. When the stand 30 is adjusted so that the apex members 31-1 and 31-2 respectively occupy the apertures P3-1 and P3-2, the support surface is in an elevated position.

Whether the stand occupies the first pair of apertures P1, the second pair of apertures P2, or the third pair of apertures P3, the support 10 permits forward movement as indicated by the arrow F, and backward movement as indicated by the arrow B of the support surface 22, with separation of the support 10 from the members 31-1 and 31-2 inhibited by the grommets 41-1 and 41-2. Although the grommets 41-1 and 41-2 are shown at the apex positions, i.e. the peaks of the stand 30, they may be positioned at other locations on the stand as illustrated in FIGS. 3–6.

In addition the grommets 41-1 and 41-2 may be used singly or multiply and are illustratively constructed of elastomeric material to be larger, when place on the stand 30 than the apertures through which they are moved. This takes place by compression as the grommets are moved through their apertures, followed by expansion once they have cleared the apertures. Although the grommets are desirably elastomeric, non elastomeric grommets may also be employed to provide a measure of separational inhibition.

Figure 2:
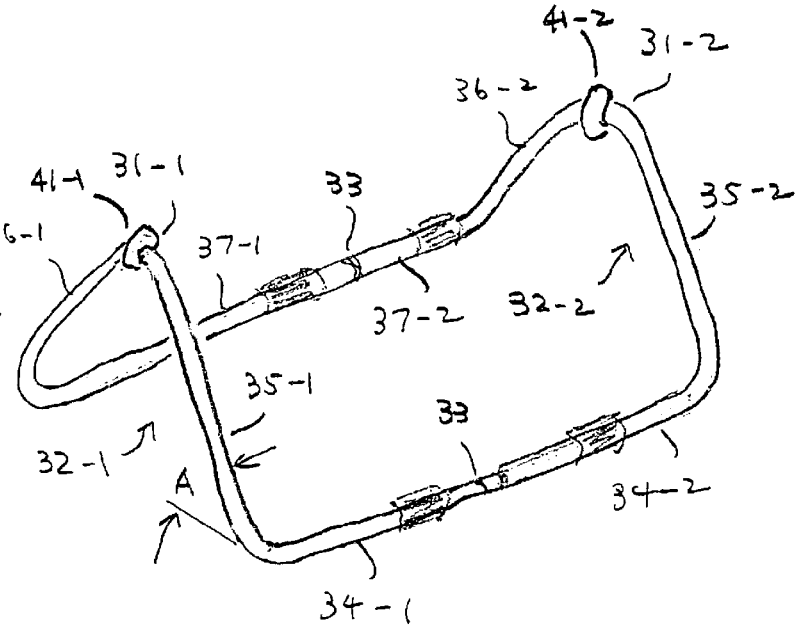
FIG. 2 is a perspective view of the support for the embodiment of FIG. 1.

As shown in FIG. 2, which is a perspective view of the support 10 for the embodiment of FIG. 1, the stand 30 is formed by a pair of tubular members 32-1 and 32-2. The members 32-1 and 32-2 are adjustable inwardly and outwardly by virtue of rods 33 which are inserted between adjoining legs of the tubular members 32-1 and 32-2. Each tubular member 32-1 or 32-2 has a leg 34-1 or 34-2 extending to an upwardly disposed connector 35-1 that forms an acute angle A with respect to the leg 34-1 or 34-2. The upward connector 35-1 or 35-2 can be extended to a downwardly disposed connector 36-1 or 36-2 attached to a leg 37-1 or 37-2. At the apexes 31-1 and 31-2 of the legs 34-1 and 34-2 there arer respective grommets 41-1 and 41-2.

Insertion of the rod 33 into a leg 34-1 of the stand 30 permits connection to an opposite leg 34-2, and relative movement between the connected legs 34-1 and 34-2. Similarly, insertion of the rod 33 into a leg 37-1 permits connection to an opposite leg 37-2. Because of the adjustability of the stand 30, the support member 20 is provided, as discussed above with a plurality of elongated apertures P1 and P2 of different lengths into which the stand 30 is insertable. As in the case of FIG. 1, the support surface 22 can be moved forwardly in the direction of the arrow F or backwardly in the direction of the arrow B.

Figure 1A:
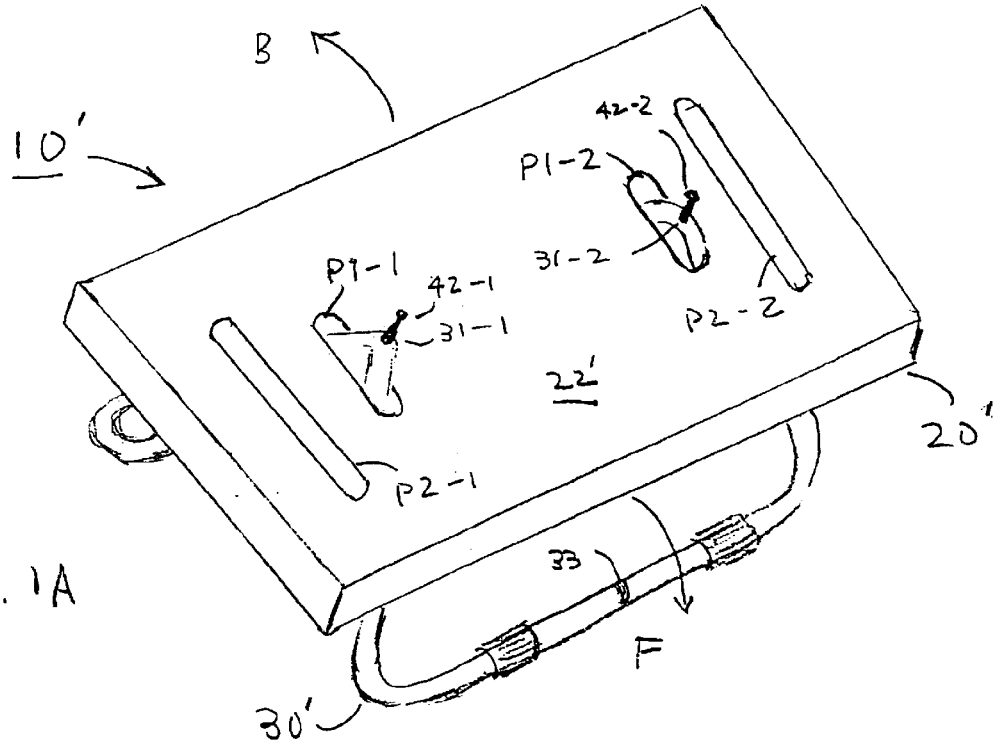
FIG. 1A is a perspective view of an adjustable support in accordance with the invention that permits forward and backward movement of its support surface and alternatively inhibits separation of the support surface from its stand.

As shown in the perspective view of FIG. 1A an alternative support 10' in accordance with the invention is formed by a support member 20' having a support surface 22' and a plurality of pairs P1 thru P2 of apertures in the support surface 22'.

In the embodiment of FIG. 1A there are two pairs of apertures P1 and P2, with the first pair P1 formed by apertures P1-1 and P1-2, and the second, longer pair P2 formed by apertures P2-1 and P2-2. The longer pair P2 accompanies the shorter pair P1 in order to permit adjustment in height of the support surface 22' with respect to a stand 30'. The support member 20' is positioned at its aperture positions over apex portions 31-1 and 31-2 of the stand 30, which includes apex inhibiting projections 42-1 and 42-2

As illustrated in FIG. 1A, the support member 20' has its apertures P1-1 and P1-2 on the apex members 31-1 and 31-2 so that the support surface 22' is in its highest position. When the stand 30' is adjusted so that the apex members 31-1 and 31-2 respectively occupy the apertures P2-1 and P2-2, the support surface 22' is in a lower position.

Whether the stand occupies the first pair of apertures P1, or the second pair of apertures P2, the support 10' permits forward movement as indicated by the arrow F, and backward movement as indicated by the arrow B of the support surface 22', with separation of the support 10 from the members 31-1 and 31-2 inhibited by the projections 42-1 and 42-2. Although the projections 42-1 and 42-2 are shown at the apex positions, i.e. the peaks of the stand 30', they may be positioned at other locations.

In addition the projections 42-1 and 42-2 may be used singly or multiply and are illustratively constructed of rigid or flexible material to be equal in width or smaller, when place on the stand 30' than the apertures through which they are moved. The projections 42-1 and 42-2 may be formed by a bend of the tubular members 36-1 and 36-2.

Figure 2A:
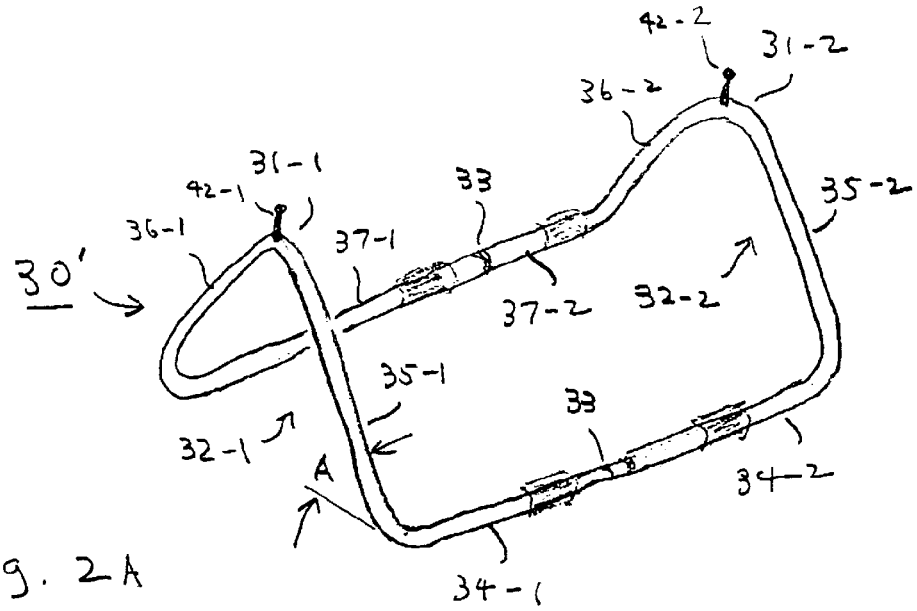
FIG. 2A is a perspective view of the support for the embodiment of FIG. 1A.

As shown in FIG. 2A which is a perspective view of the stand 30' for the embodiment of FIG. 1A, the stand 30' is formed by a pair of members 32-1 and 32-2. Although the tubular members 36-1 and 36-2 have circular cross-sections, other cross sections are suitable, including elliptical and rectangular. Alternatively the 32-1 and 32-2 may be solid rods or take the form of rectangular channel members having an open forth side.

In addition, although the members 32-1 and 32-2 are adjustable inwardly and outwardly by virtue of rods 33 which are inserted between adjoining legs 32-1 and 32-2, the legs 32-1 and 32-2 may be separate structures that are independently movable with respect to the apertures P1 and P2. Although the upwardly disposed connector 35-1 in FIG. 2A forms an acute angle A with respect to the leg 34-1, the angle A may be increase to about ninety degrees and the legs 34-1 and 37-1 extended, for example at a right angle to provide base support for the connectors 35-1 and 36-1.

At the apexes 31-1 and 31-2 of the legs 34-1 and 34-2 there are respective projections 42-1 and 42-2. The projections 42-1 and 42-2 can take the form pins inserted thru the connectors 36-1 and 36-2, and capped with a rounded end to avoid stick injuries to the user.

For adjustability of the stand 30' of FIG. 1A, the support member 20' is provided, as discussed above with a plurality of apertures P1 and P2 into which the stand 30' is insertable. As in the case of FIG. 1, the support surface 22 can be moved forwardly in the direction of the arrow F or backwardly in the direction of the arrow B.

Figure 3:
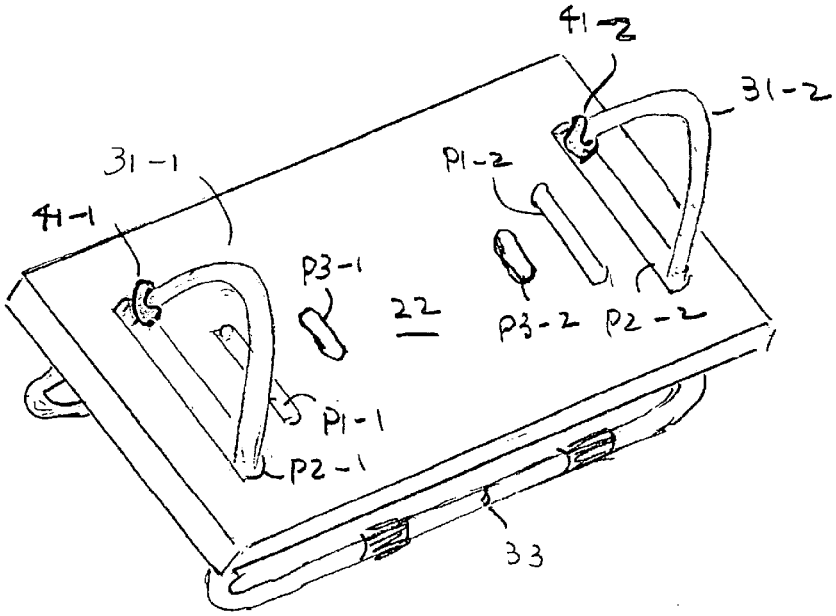
FIG. 3 is a perspective view of the support of FIG. 1 for which the support surface has been lowered by being moved to the outermost support position of the stand with inhibition of separation of the support surface from its stand at the lowered position.

As shown in FIG. 3, which is a perspective view of the support of FIG. 1, the support surface 22 has been lowered by being moved to the outermost support position provided by the apertures P2 of the stand 30. The grommets 41-1 and 41-2 have been lowered to stabilize the new position of the support surface 22.

Figure 4:
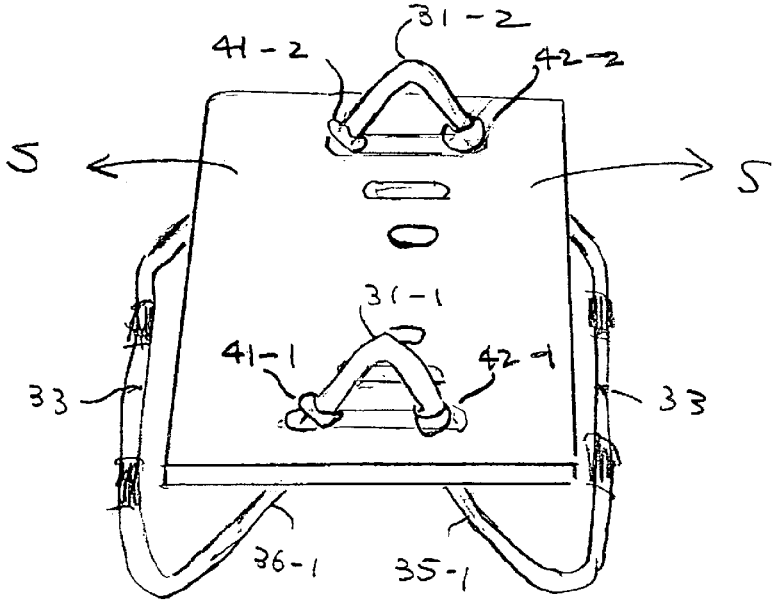
FIG. 4 is a perspective view of the support of FIG. 3 which has been positioned for possible side-to-side movement of an object placed on the support surface with double inhibition of separation of the support surface from its stand.

By contrast, with FIG. 3, FIG. 4 is a perspective view of the support of FIG. 3, which has been positioned for possible side-to-side movement indicated by the arrows S of an object placed on the support surface 22. Each leg of the stand 30 includes two grommets 41-1 and 42-1 on one leg, and grommets 41-2 and 42-2 on the other leg.

Figure 5:
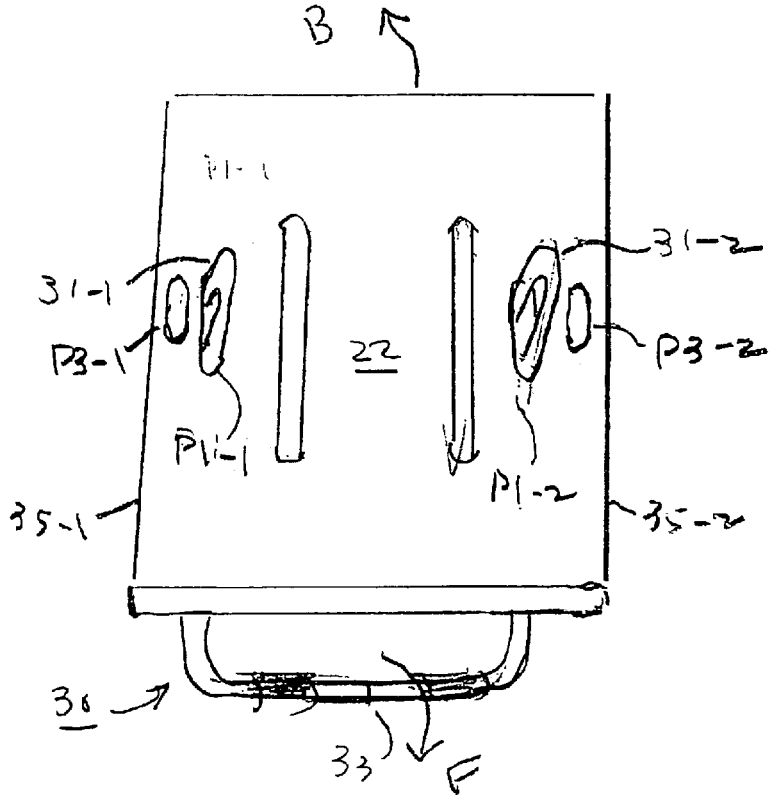
FIG. 5 is a perspective view of an alternate embodiment in which the elongated support surface of FIG. 4 has been positioned for possible forward and backward movement.

In the alternative embodiment of FIG. 5, the elongated support surface 22 of FIG. 4 has been positioned for possible forward and backward movement, again indicated by the arrows F and B by the use of an elongated pair of apertures P1-1 and P1-2. In addition, a further set of shorter apertures P3-1 and P3-2 are positioned near the respective elongated edges 35-1 and 35-2 to permit forward and backward movement of the support surface 22 in the position of maximum elevation for the support 10.

Figure 6:
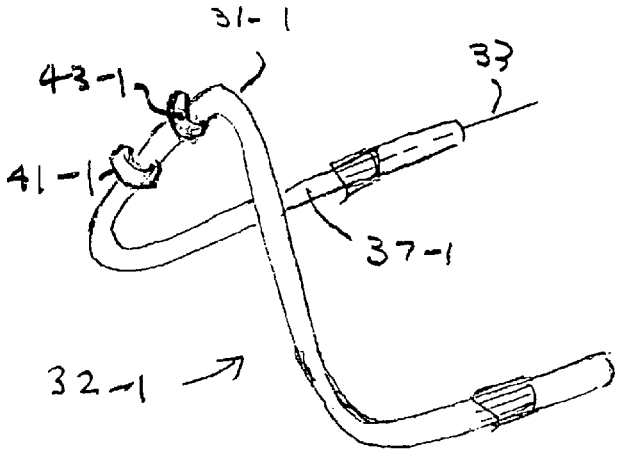
FIG. 6 is a perspective view showing separation of the tubular members forming the stand and indicating the use of two objects for inhibiting the separation of the support surface from its stand at two different levels.

To clarify the relationship of the rods 33 to the stand members 32-1 and 32-2, the portion 32-1 is shown in FIG. 6 separated from the portion 32-2, with one rod 33 removed and the other rod 33 retained in only one leg. In addition the leg 32-1 is shown with two grommets 41-1 and 43-1 at two separated positions on the leg below the apex 31-1. This provides inhibition of the separation of the support from the stand at two different positions. It is apparent that one or more grommets may be used for each different support position It will be understood that the foregoing detailed description is illustrative only and that modifications may be made without the departing from the spirit and scope of the invention as defined in the appended claims.

What is claimed:

1. Apparatus comprising: a rest member having a support surface; and a stand for said rest member; said rest member having a plurality of elongated apertures of different lengths therein to permit the adjustment in height thereof with respect to said stand; and said stand having means thereon for inhibiting any tendency for the stand to become separated from said rest member during usage thereof.

2. Apparatus as defined in claim 1 wherein the inhibiting member is movable inwardly and outwardly.

3. Apparatus comprising:

a rest member having a support surface; and a stand for said rest member;

said rest member having apertures therein to permit the adjustment in height thereof with respect to said stand; and said stand having means thereon for inhibiting any tendency for the stand to become separated from said rest member during usage thereof wherein the inhibiting means comprises an elastomeric object taking the form of a rubber ring.

4. Apparatus as defined in claim 3 wherein the inhibiting means is compressible to permit said stand to be inserted thru said rest member and expandable thereafter to inhibit separation of said rest member from said stand.

5. Apparatus as defined in claim 4 wherein said inhibiting means comprises at least one object.

6. Apparatus as defined in claim 5 wherein said stand has a tubular portion and said object is attached to said tubular portion.

7. Apparatus as defined in claim 5 wherein said object projects from said stand.

8. Apparatus as defined in claim 3 wherein the inhibiting means comprises a plurality of elastomeric objects.

9. Apparatus as defined in claim 3 wherein said said stand has an apex and the inhibiting means is positioned at said apex.

10. The method of supporting an object comprising the steps of:

(a) providing a rest member having a support surface;

(b) forming a plurality of differently dimensioned constructs in said support surface; and (c) positioning said rest member on a stand therefor to permit the adjustment in height of said rest member with respect to said constructs (d) further including the step of providing said rest member with a plurality of elongated apertures of different lengths into which said stand is inserted into two of said apertures and inhibited from separation therefrom by an inhibiting means.

11. The method as defined in claim 10 further including the step of positioning means for inhibiting the accidental separation of said stand from said rest member after said stand has engaged said constructs.

12. The method as defined in claim 11 wherein said constructs are apertures further including the step of inserting the inhibiting means into said apertures.

13. The method as defined in claim 12 wherein said stand has at least one apex further including the step of positioning said inhibiting means at said apex.

14. The method as defined in claim 11 wherein the inhibiting means comprises an elastomeric object further including the step of engaging at least one of said constructs by said elastomeric object.

15. The method as defined in claim 14 wherein said elastomeric object is a rubber ring further including the step of engaging at least one of said constructs by said rubber ring.

16. The method as defined in claim 15 wherein at least one of said constructs is an aperture smaller than the maximum dimension of said rubber ring when positioned on said stand and further including compressing said rubber ring to allow insertion into said aperture.

17. The method as defined in claim 16 further including the step of pushing said rubber ring thru said aperture.

18. The method as defined in claim 17 further including the step of variably positioning said rubber ring on said stand.

* * * * *